US009643294B2

(12) United States Patent
Luna et al.

(10) Patent No.: US 9,643,294 B2
(45) Date of Patent: May 9, 2017

(54) BUFFING PAD AND METHODS OF MAKING AND USING THE SAME

(71) Applicant: K&D Pads LLC, Tustin, CA (US)

(72) Inventors: Kenneth Luna, San Clemente, CA (US); Derek Geisen, Tustin, CA (US)

( * ) Notice: Subject to any disclaimer, the term of this patent is extended or adjusted under 35 U.S.C. 154(b) by 0 days.

(21) Appl. No.: 14/799,498

(22) Filed: Jul. 14, 2015

(65) Prior Publication Data

US 2017/0014974 A1 Jan. 19, 2017

(51) Int. Cl.

| | |
|---|---|
| ***B24D 13/14*** | (2006.01) |
| ***B24D 13/20*** | (2006.01) |
| ***B24D 9/08*** | (2006.01) |
| ***B24B 37/26*** | (2012.01) |
| ***B24D 18/00*** | (2006.01) |

(52) U.S. Cl.

CPC ..... *B24D 13/145* (2013.01); *B24B 37/26* (2013.01); *B24D 9/08* (2013.01); *B24D 13/14* (2013.01); *B24D 13/142* (2013.01); *B24D 13/20* (2013.01); *B24D 18/0045* (2013.01)

(58) Field of Classification Search

CPC .... B24D 13/14; B24D 13/142; B24D 13/145; B24D 13/20; B24D 9/08; B24B 37/26

USPC ..... 451/527, 530, 532, 536, 537

See application file for complete search history.

(56) References Cited

U.S. PATENT DOCUMENTS 3,013,366 A * 12/1961 Becker ..... B24D 9/08 15/230.12
3,100,905 A * 8/1963 Salick ..... A46B 13/008 15/230.19
4,069,538 A * 1/1978 Fallen ..... A47L 11/164 15/230.1
5,383,309 A * 1/1995 Sampietro ..... B24D 9/08 451/533
6,137,387 A * 10/2000 Van Zeeland ..... H01H 9/04 335/177
6,223,383 B1 * 5/2001 VanPutten ..... A47L 11/164 15/230
2005/0060829 A1 * 3/2005 Silvers ..... A47L 11/164 15/230
2005/0106359 A1 * 5/2005 Zou ..... B24B 37/042 428/156
2005/0227599 A1 * 10/2005 Fisher ..... B24B 23/005 451/526
2007/0243798 A1 * 10/2007 Annen ..... B24D 3/002 451/28
2008/0085661 A1 * 4/2008 Hsu ..... B24B 37/26 451/59
2011/0265277 A1 * 11/2011 Elizondo ..... A47L 13/44 15/228
2012/0258652 A1 * 10/2012 Koehnle ..... B24B 37/26 451/526
2015/0202732 A1 * 7/2015 Feng ..... B24B 37/24 451/287

* cited by examiner

*Primary Examiner* — Eileen Morgan
(74) *Attorney, Agent, or Firm* — Law Office of Benjamin Diederich; Benjamin Diederich

(57) ABSTRACT

A buffing pad having a front surface portion, a moisture barrier upon which the front surface is disposed, a compressible foam portion disposed below the moisture barrier, and a rear surface. The front surface portion has a plurality of indentations formed by RF welding and the rear surface has an attachment portion capable of attaching the buffing pad to a power tool. Methods of manufacturing and using a buffing pad.

16 Claims, 5 Drawing Sheets

BUFFING PAD AND METHODS OF MAKING AND USING THE SAME

CROSS-REFERENCE TO RELATED APPLICATIONS

Not Applicable

STATEMENT RE: FEDERALLY SPONSORED RESEARCH/DEVELOPMENT

Not Applicable

BACKGROUND

Field of the Invention

The present disclosure relates generally to a buffing pad for polishing the surface of an item. More particularly, the buffing pad includes a plurality of indentations for improved polishing performance.

Description of the Related Art

Attempts are constantly being made, by both manufacturers and aftermarket industries, to improve the visual appearance of painted surfaces, for example, the painted surface exteriors of vehicles. In particular, there are numerous cleaning, waxing, and polishing compositions and applicators on the market to restore the aesthetic appearance of painted surfaces created over time by scratches, dust, and hazing. Typically, these polishing products use an abrasive material or composition to remove surface defects in a "buffing" process, but by doing so can leave a level of scuff or "swirl" marks that also needs to be removed to achieve a satisfactory level of aesthetic performance. The swirl is hence removed via a "finishing" process. The finishing process, however, typically leaves behind a certain level of "haze" that is difficult to remove completely or even to a satisfactory level. In particular, it is all too common for the haze to be difficult or impossible to see by the naked eye in typical detailing situations, for example in the shade or indoor lighting, but becomes apparent when brought into bright sunlight.

Polishing processes typically use a "buffing pad" to apply polishing products in the steps described above. These buffing pads may either be used manually, or attached to power tools to increase the efficiency of the process. The buffing pads are typically compressible to allow for the application of even pressure to the painted surface being worked, and are typically made from a polymeric foam substance. As described above, there are certain performance factors in the polishing process, which tend to be inversely related to each other. That is, one desires to have a high level of "cut" (the rate at which the pad removes surface defects) in order to speedily and efficiently allow the polishing process to occur in a reasonable time. However, the higher the level of cut, typically increases the level of haze left behind. A second performance factor in the polishing process is the level of "finish", that is, how much haze is ultimately left behind on the surface at the end of the polishing process. It has been difficult in the past to produce a buffing pad that has both a high level of cut and a high level of finish, as performance increases in one factor would typically tend to diminish the performance of the other factor. Thus, there is a need in the art for a buffing pad that is able to achieve both a high level of cut and a high level of finish during a polishing process.

BRIEF SUMMARY

In accordance with one embodiment of the present disclosure, there is contemplated a buffing pad having a front surface portion, a moisture barrier upon which the front surface is disposed, a compressible foam portion disposed below the moisture barrier, and a rear surface. The front surface portion has a plurality of indentations and the rear surface has an attachment portion capable of attaching the buffing pad to a power tool.

The front surface portion may be formed from a fur-like fabric. In particular, the front surface portion may be formed from a polyester fabric. The polyester fabric may have a plurality of hairs on its surface. Further, the hairs may generally have an approximate length of 2 mm, and may be formed in a pattern such that at least one portion of hairs face in a direction different from the direction the hairs in a second portion face. More particularly, the hairs may be oriented such that there is a central section of hairs wherein the hairs are oriented in one direction and there are two outer sections disposed on either side of the central section wherein the hairs are oriented in a direction different from that of central section.

The moisture barrier may be formed from a urethane film and may be approximately 1 mil thick. The compressible foam portion may be formed from a polyester foam. More particularly, the polyester foam may have a 1.5-pound density and may be approximately 0.5 inches thick. The rear surface may be formed from a brushed nylon material and the attachment portion may be made from one half of a hook and loop system.

The plurality of indentations may be formed in numerous patterns. In one embodiment they are formed such that there is a circular central indentation disposed in the center of the front surface portion. Additionally, there may be three elongated secondary indentations located in the middle third of the front surface and disposed radially outward from the central indentation. Further, there may be three significantly elongated tertiary indentations located in the outer third of the front surface and disposed radially outward from the secondary indentations.

In one particular embodiment, the front surface may be approximately seven inches in diameter. Additionally, the central indentation may be approximately 1.5 inches in diameter. Further, the three secondary indentations may be bean-shaped, with a curvature facing inward toward the central indentation. These secondary indentations may be disposed approximately 0.5 inches outward from the central indentation, and have a major axis of approximately 1.5 inches long, and a minor axis approximately 0.5 inches wid. The secondary indentations may be disposed approximately equidistant apart, thereby forming a broken circle pattern. Additionally, the tertiary indentations may be bean-shaped, with a curvature facing inward toward the central indentation. The tertiary indentations may have a major axis approximately 2.5 inches long and a minor axis approximately 0.5 inches wide. These three tertiary indentations may be disposed approximately equidistant apart forming a broken circle pattern. The tertiary indentations may be placed such that gaps between the tertiary indentations follow a line radiating outward from the central indentation and through a center point of the secondary indentations. The indentations may be formed by RF (Radio Frequency) welding.

Another embodiment of the present disclosure contemplates a method of manufacturing a buffing pad described above. The method may follow the steps of (such steps may be performed in a different order than described below) placing a fur-like polyester material on top of a 1 mil thick urethane film to form two layers. The polyester material may have a plurality of approximately 2 mm hairs on its surface.

These two layers may be placed on top of a compressible polyester foam to form three layers. The compressible polyester foam may be approximately 0.5 inches thick The three layers may then be placed on top of a brushed nylon material having one half of a hook and loop system on its back surface to form four layers. The four layers are then heated to bond the layers together. Finally, a pattern of indentations are formed in the surface of the fur-like polyester material with RF welding.

Yet another embodiment of the present disclosure contemplates a method of polishing the painted surface of a material. This method follows the steps of applying a polishing composition to a buffing pad as described above, attaching the buffing pad to a power tool (for example, a random orbit sander), and polishing the surface of the painted material.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
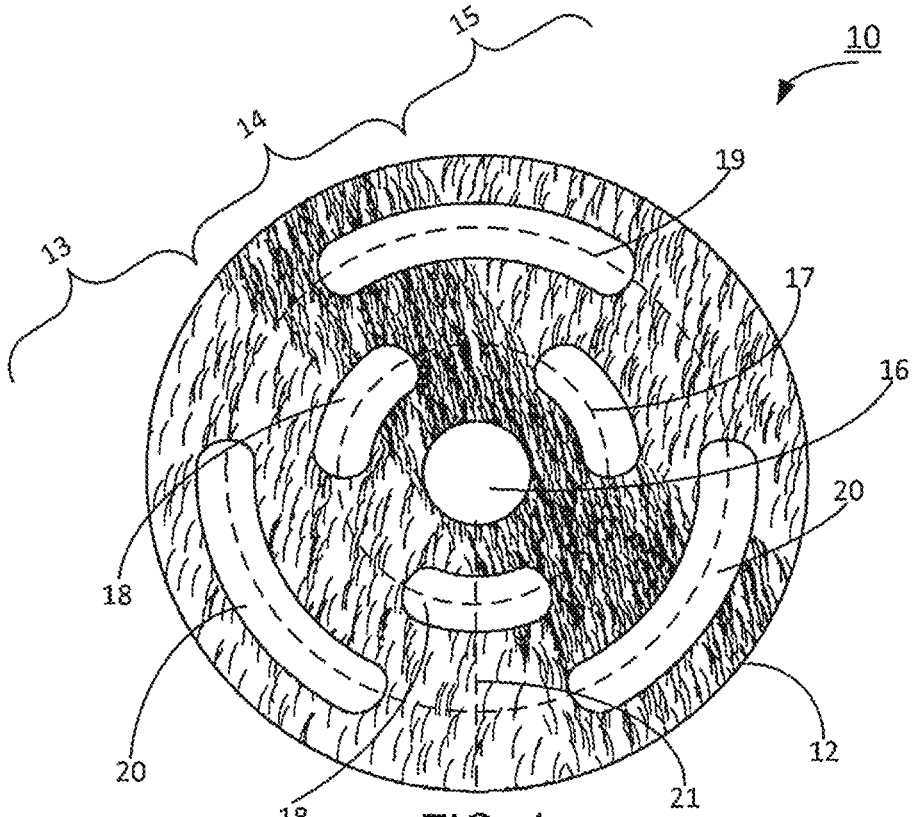
FIG. 1 is a top view of a buffing pad according to one exemplary embodiment of the disclosure.

A first embodiment of the buffing pad 10 is illustrated in FIGS. 1-4. As shown in FIG. 1, the pad 10 has a front surface 12. This front surface 12 may be made up of a 100% polyester soft fur fabric having pile or individual "hairs" on the surface to create a soft face that comes into contact with the surface to be worked. This front surface 12 may optionally comprise cross-directional sections of hairs 13, 14, 15, wherein the hairs are oriented in differing directions. It is believed that having the hairs oriented in differing directions leads to increased cut, improved finishing, and reduced heat build up during the polishing process. For example, in the embodiment shown in FIG. 1, there is a central section of hairs 14 wherein the hairs are oriented in one direction, and outer sections of hairs 13, 15, wherein the hairs are oriented in a direction different from that of central section 14. It is to be understood that other patterns of cross-directional hairs may be utilized on the front surface 12.

Additionally, the front surface 12 includes a plurality of indentations, or depressed regions. As opposed to the prior art, these indentations are not cut into the pad 10, and do not extend fully through the pad 10, but rather are true indentations in the surface of the pad 10. The benefits of these indentations include increased cut without a significant increase in heat build up during the polishing process. The cutting of apertures in the prior art would leaves these apertures with rough edges that unfortunately led to an increase in heat buildup during the polishing process. These rough edges are avoided by using RF welding to create the indentations, thereby avoiding scratching the surface to be polished and minimizing friction/heat buildup. While it is understood that the pattern of indentations may vary, a preferred pattern is shown in FIG. 1 featuring three zones of indentations. In particular, there is a circular central indentation 16 located approximately in the center region of the front surface 12. There is also a plurality of elongated secondary indentations 18 located in the middle third of the front surface 12 and disposed radially outward from the central indentation 16. Finally, there is a plurality of significantly elongated tertiary indentations 20 located in the outer third of the front surface 12 and disposed radially outward from the secondary indentations 18.

In one particular embodiment, front surface 12 of the pad 10 is approximately seven inches in diameter and is approximately half an inch thick. Further, the central indentation 16 is circular in shape and approximately 1.5 inches in diameter. The secondary indentations 18 are fashioned in a bean-shaped or curving ellipse design, with the curvature facing inward toward the central indentation 16. In this particular embodiment there are three secondary indentations 18 disposed in a radial fashion surrounding the central indentation 16 and placed approximately 0.5 inches outward from the central indentation 16. The major axis of the secondary indentations 18 is approximately 1.5 inches long, while the minor axis of the secondary indentations is approximately 0.5 inches wide. The secondary indentations 18 are placed in a circular plane 17 located in approximately the middle third of the front surface 12 and are placed approximately equidistant around the circular plane 17 to create a broken circle pattern. The tertiary indentations 20 are likewise fashioned in a bean-shaped or curving ellipse design, and are even more extended than the secondary indentations 18. In this particular embodiment, the major axis of the tertiary indentations 20 is approximately 2.5 inches long and the minor axis of the tertiary indentations 20 is approximately 0.5 inches wide. In this embodiment, there are also three tertiary indentations 20 placed in a circular plane 19 located in approximately the outer third of the front surface 12 and are placed approximately equidistant around this circular plane 19 to create a broken circle pattern. In particular, the tertiary indentations 20 are disposed on the front surface 12 such that gaps between the tertiary indentations 20 follow a line 21 radiating outward from the central indentation 16 and through a center point of the secondary indentations 18. It is to be understood, however, that various different sizes of indentations and patterns of indentations may be utilized. In particular, the absolute sizes of indentations may be changed to create a pad of a different size while maintaining the same ratio of indentation sizes in comparison to each other and to the overall pad.

Figure 2:
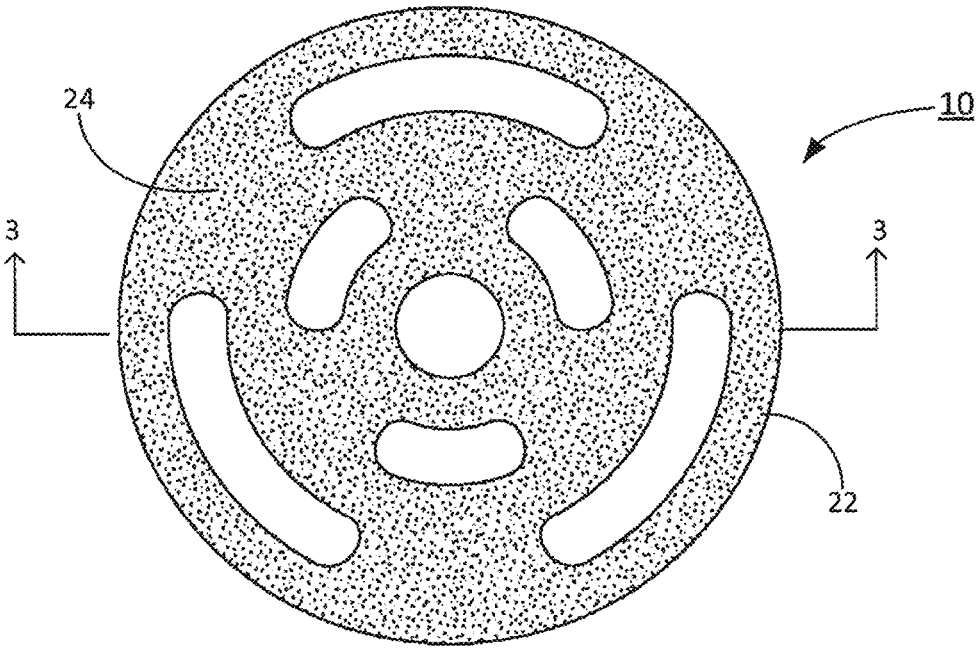
FIG. 2 is a bottom view of the buffing pad shown in FIG. 1.

As shown in FIG. 2, the pad 10 also has a rear surface 22 that includes an attachment portion 24 capable of being attached to a power tool, for example, a random orbit sander. In some embodiments, for example, the attachment portion 24 is one half of a hook and loop system, wherein the other half of the hook and loop system is on the power tool. This allows for easy attachment and removal from the power tool as the need may be during the polishing process. The rear surface 22 and attachment portion 24 may be made of various materials, and may in particular be made of a brushed nylon fabric. In one particular embodiment, the brushed nylon fabric of the rear surface 22 may be a 3.8 oz. 100% nylon fabric produced by California Combining Corp. of Los Angeles, Calif.

Figure 3:
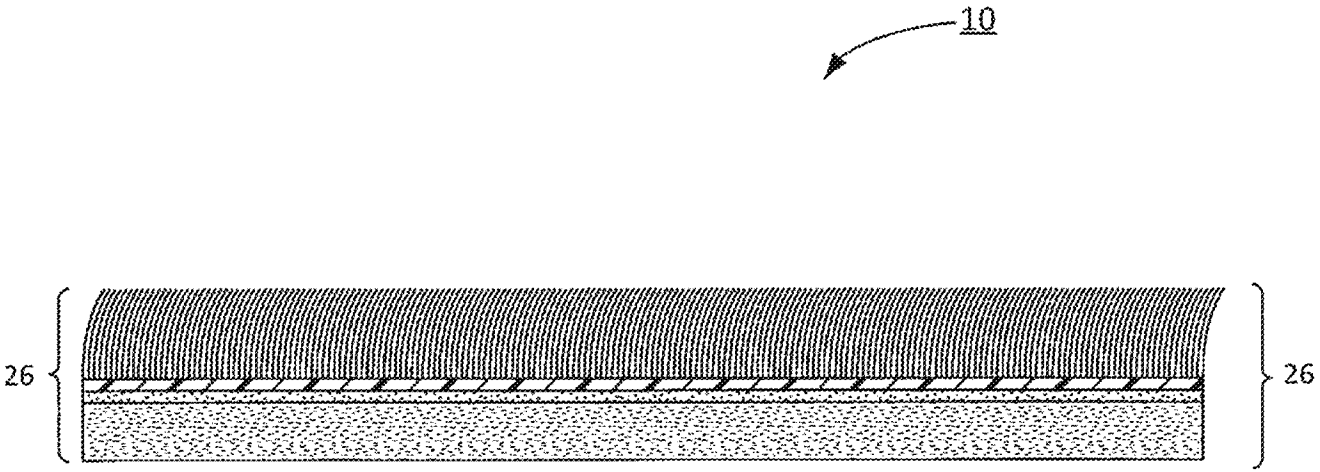
FIG. 3 is a cross-sectional view of the buffing pad along the line 3-3 in FIG. 2.
Figure 4:
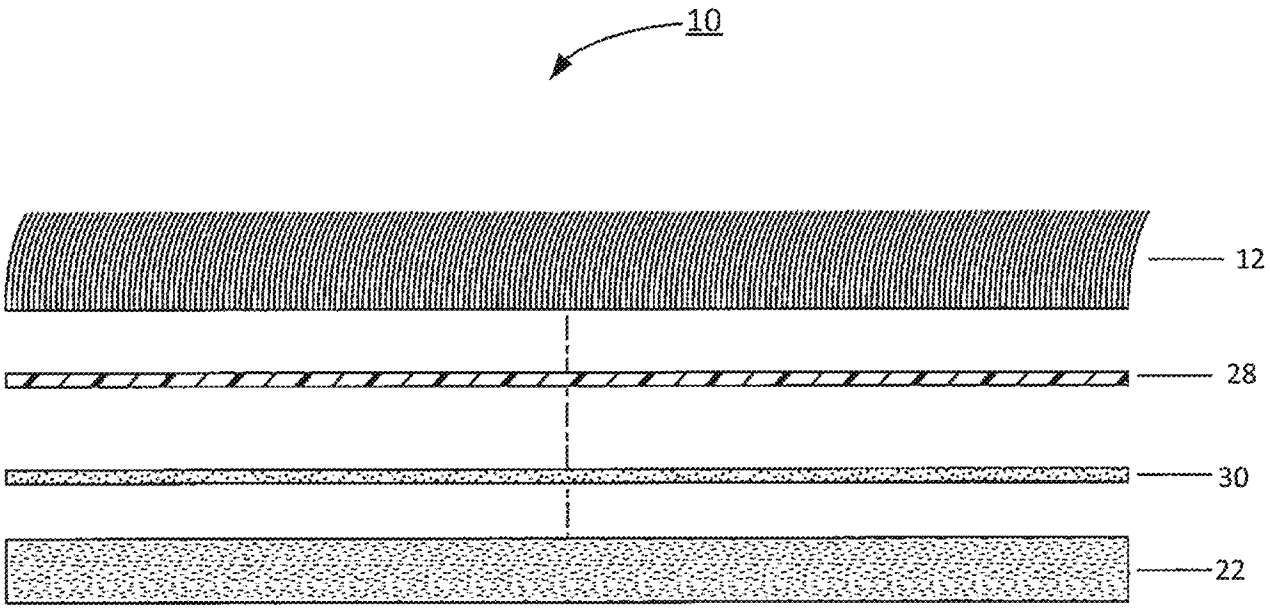
FIG. 4 is a is an exploded view of the buffing pad shown in FIG. 3.

As can be seen in FIG. 3, the pad 10 further includes a side surface 26 formed in four layers. It should be noted that these layers are shown illustratively only and are not to scale. These four individual layers can best be seen in FIG. 4, which is an exploded view of FIG. 3. Working from the bottom layer up, there is first the rear surface 22, followed by a compressible foam layer 30, then a moisture barrier 28, and finally the front surface 12.

As discussed above, the rear surface 22 may be formed out of a brushed nylon fabric, for example, one provided by California Combining Corp. The rear surface 22 is attached to the compressible (or pinchable) foam layer 30 that provides the majority of the resiliency to the pad 10. This foam layer 30 may be fabricated from any compressible material known in the art, and certain examples of this are described in U.S. Pat. No. 8,197,307 and U.S. Patent Application Publication No. 2012/0258652, both of which are hereby incorporated by reference in their entireties. In some embodiments, the foam layer 30 may be formed from a polymeric foam. In particular, the foam layer 30 may be fabricated from an open-celled polyester foam. In one particular embodiment, the foam layer 30 is formed from a half-inch thick 1.5 lbs. density polyester foam, such as those available from California Combining Corp. As can be ascertained, the foam layer 30 provides the vast majority of the overall thickness to the pad 10, as the remaining layers are significantly thinner in comparison.

The next layer is the moisture barrier 28, which can be fabricated from any material suitable to prevent liquid from flowing through from the front surface 12 to the foam layer 30 and through to the rear surface 22. Ideally, the moisture barrier 28 is made up of a flexible material, to allow the entire pad 10 to remain flexible. By including this moisture barrier 28, the pad 10 can be used for a significantly longer time than pads known within the art, as liquid penetrating through the entirety of the pad would lead to a wetted rear surface 22 which could potentially interfere with the attachment of the pad to the power tool being used for the polishing process. Furthermore, the inclusion of the moisture barrier 28 can reduce the amount of polishing product needed to be used in the polishing process, as the moisture barrier 28 stops the flow of product into the foam layer 30, which would then retain the product within the foam, rather than maintaining the product at the front surface 12. The moisture barrier, in certain embodiments, may be made up of a urethane film. In particular, one may use a 1 millimeter thick urethane film for the moisture barrier 28. In particular, such a 1 millimeter thick urethane film may be obtained from California Combining Corp. The moisture barrier 28 may be attached to the front surface 12 and foam layer 30 via any known process in the art, but may particularly utilize a heat reactive polyolefin adhesive (not shown) to permanently attach the moisture barrier 28.

Finally, the front surface 12 may be formed from a fur-like fabric that features "hairs" or pile on the face of the surface 12. These hairs may be approximately 2 mm in length. Additionally, the fur-like fabric of the front surface 12 may be formed from 100% polyester fabric. In one embodiment, the front surface 12 is formed from a soft fur solid 58/60" nylon fabric produced by Shannon Fabrics of Los Angeles, Calif. As can be seen from FIGS. 3 and 4, the front surface 12 is attached to the moisture barrier 28, and the moisture barrier 28 is attached to the foam layer 30. While these layers may be attached by any method known within the art, in one embodiment they are attached by flame bonding the layers to each other.

Figure 5:
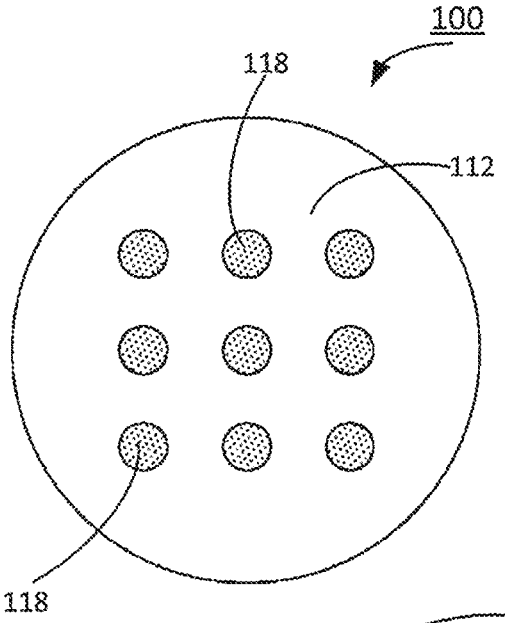
FIG. 5 is a top view of a second exemplary embodiment of the buffing pad described herein.
Figure 6:
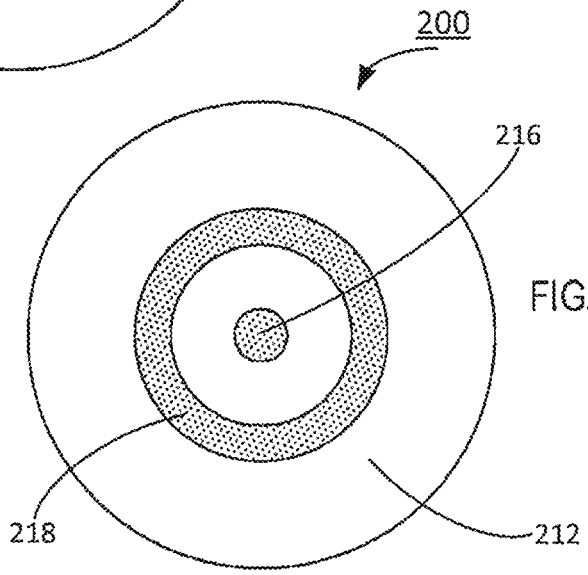
FIG. 6 is a top view of a third exemplary embodiment of the buffing pad described herein.
Figure 7:
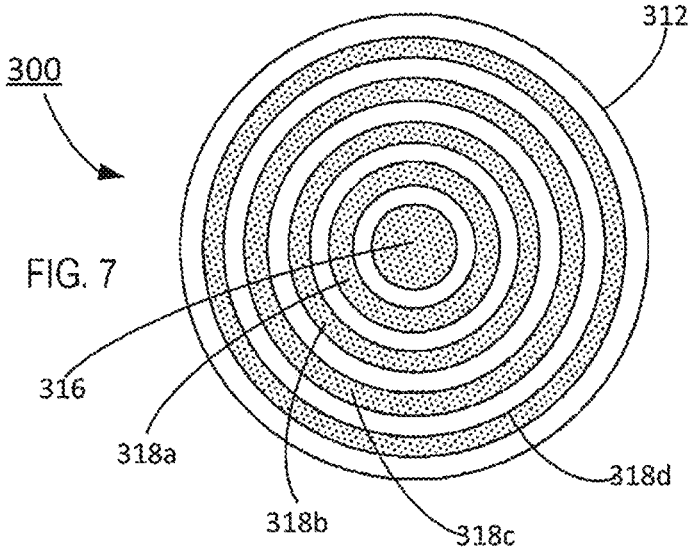
FIG. 7 is a top view of a fourth exemplary embodiment of the buffing pad described herein.

As it is understood that various patterns of indentations on the front face of the pad may achieve satisfactory results, this disclosure is not intended to be limited to any particular pattern. To that end, various embodiments showing different indentation configurations are shown in FIGS. 5, 6, and 7. In particular, FIG. 5 illustrates a second embodiment of a pad 100 featuring a plurality of circular indentations 118 arranged on the front surface 112 of the pad 100 in a square pattern. In particular, FIG. 5 illustrates nine indentations 118 arranged in a 3×3 square grid. It should be understood, however, that various other size grids, e.g., 2×2 and 4×4 may be used, that the indentations 118 may take the form of various shapes, e.g., triangles, squares or ovals, and the shape of the overall grid may take various patterns, e.g., triangles, rectangles, or circles. FIG. 6 illustrates a third embodiment of a pad 200 that features a circular central indentation 216 surrounded by an annular ring indentation 218. It should be understood that the sizes and distances between the central indentation 216 and the ring indentation 218 can be modified and be within the scope of the present disclosure. Furthermore, more than one annular ring indentation may be utilized. This is shown in FIG. 7, wherein a fourth embodiment of a pad 300 illustrates a larger central indentation 316 surrounded by a plurality of annular ring indentations 318*a*, 318*b*, 318*c*, and 318*d*. While four annular ring indentations 318 are shown in FIG. 7, it is to be understood that fewer or greater numbers of ring indentations 318 may be used and the distances between such ring indentations 318 and between a first ring indentation 318*a* and the central indentation 316 may be varied.

Another embodiment of the present disclosure includes a method of manufacturing pads as described above. In a particular embodiment, the four layers of the pad 10 are assembled in an ordered fashion working from the bottom piece to the top. First, the foam layer 30 is placed upon the rear surface 22. Next, the moisture barrier 28 is positioned with a heat reactive polyolefin disposed above and below it. While it should be understood that the use of a heat reactive polyolefin is optional, and/or a different adhesive material may be utilized, in one particular example, the heat reactive polyolefin is applied at 0.55 grams per square yard.

Finally, the front surface 12 is placed upon the moisture barrier 28 (and optional heat reactive polyolefin). When all four layers are in proper position, the layers of the pad 10 may then be heated under any suitable methodology within the art, for example flame bonding, to permanently attach the layers to each other, thereby creating a single unitary pad 10 piece.

This unified pad 10 then undergoes an RF (Radio Frequency) welding procedure to create the indentations on the front surface 12 of the pad 10. In particular, the pad 10 is inserted into an RF welding machine containing an emboss plate template featuring the desired indentation pattern to be formed in the front surface 12 of the pad 10. One certain RF welding machine suitable for use is High Frequency Generator Model #6500 F.S. available from Kabar Manufacturing Corporation of Long Island, N.Y. Using such a model, the power level may be set at #6 and a process is run wherein pressure is applied for three seconds, heat is applied for three seconds, and a cooling time of three seconds is utilized.

Yet another embodiment of the present disclosure includes a method of polishing a painted surface using buffing pads as described above. In particular, the pads described above may be used in a conventional polishing process (for example, by attaching the pad to a random orbit sander) to achieve a substantially improved final polish having both exceptionally high cut and exceptionally low haze without requiring multiple steps. It should be understood that the pads described herein may be used with or without polishing compositions. Further, if a polishing composition is utilized, it may be one of many products known within the art. For example, one could use the pads described herein with the polishing compositions described in U.S. Pat. No. 8,197,307. By utilizing pads as described herein, the polishing process produces less friction, and thus less heat because the elongated indentations allow for less surface contact between the pad and the surface being polished preventing the buildup of heat. Furthermore, the utilization of RF welding to form the indentations leaves no hard edges to scratch the surface of paint being polished. Additionally, the cross-directional hairs on the surface of the pad allows for a greater level of cut, thereby reducing the time needed to polish preventing the overheating of the surface being polished or the tool being used in the polishing procedure. The cross-directional hairs may further allow for both cut and polish steps to occur at the same time, thereby reducing the time and steps necessary during a polishing prodecure. As well, the addition of the moisture barrier allows for increased longevity of the pads as any polishing liquids being utilized will not permeate through to the foam layer or rear surface which can allow the pad to degrade in an untimely manner, and to require the use of a greater amount of polishing product.

Figure 8:
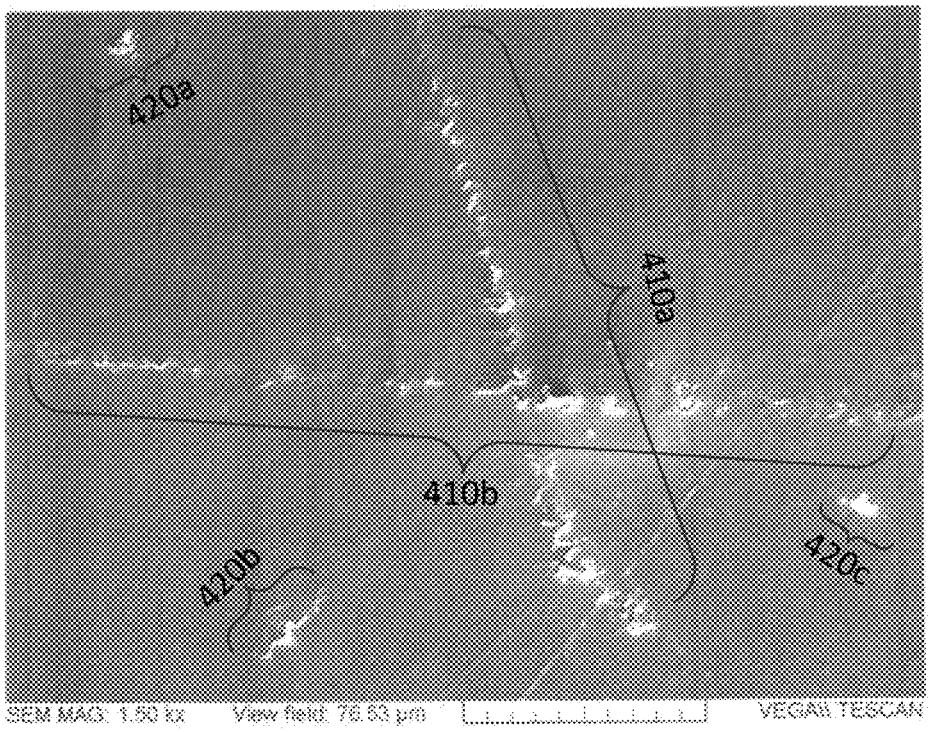
FIG. 8 is a microscopic photograph of a painted surface polished using a buffing pad within the prior art.
Figure 9:
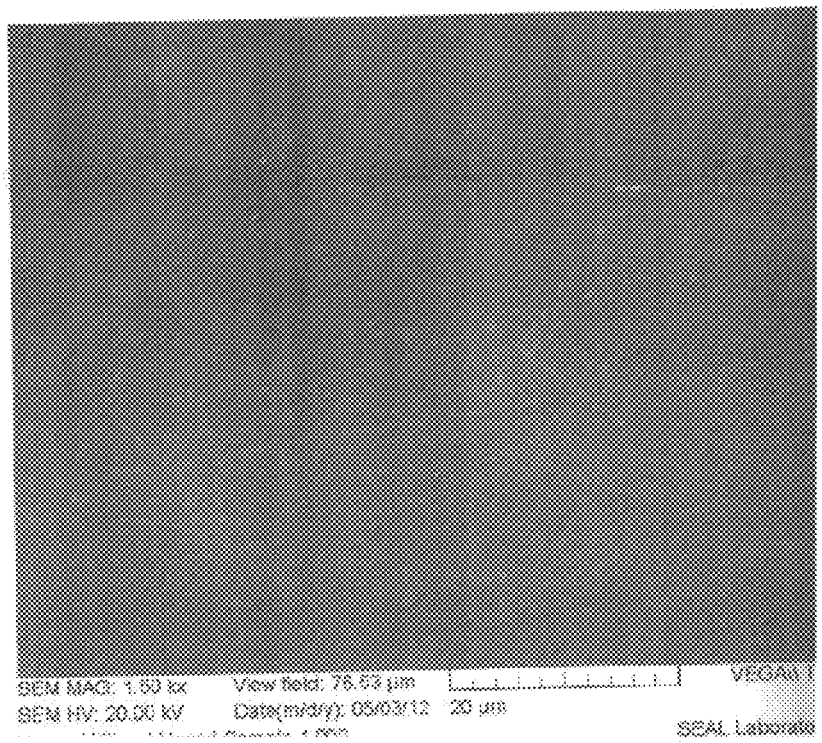
FIG. 9 is a microscopic photograph of a painted surface polished using the buffing pad described herein.

In an effort to highlight the vastly increased results capable of being achieved using pads as described herein, FIG. 8 is a photograph of a painted surface 400*a* polished using pads previously known within the art. This photograph is shown at 1,500× magnification. As can be readily seen in FIG. 8, there remain long swirls 410*a*, 410*b* and surface imperfections 420*a*, 420*b*, and 420*c*, even after polishing as known in the art. These scratches 410 and imperfections 420 result in haze and imperfections when viewed by the naked eye. In sharp contrast, FIG. 9 is a photograph at the same magnification of the same painted surface 400*b*, when polished using the pads as described herein. No changes in polishing compositions or polishing times were made between the photograph in FIG. 8 and in FIG. 9. As can readily be seen, the swirls 410 and imperfections 420 are not present on the painted surface 400*b* when the pads of the present disclosure are utilized. Accordingly, when viewed with the naked eye, even under direct sunlight (where imperfections are best seen), there is no readily visible haze on the painted surface.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments. In particular, while disclosure herein may focus on the use of the buffing pads in automotive applications, that is, to polish a painted exterior surface of an automobile to create a glossy appearance free from surface defects and haze, it is understood that the buffing pads may be used in numerous other applications, such as, but not limited to, marine and aeronautical applications and other painted, or non-painted surfaces or articles that would benefit from polishing. Furthermore, it is intended that the buffing pads described herein may be utilized with various power tools, including random orbit sanders and the like to create the motion necessary to polish the intended surface, and may be used with or without abrasive polishes known within the art, whether in liquid or solid form. Additionally, the pads described herein may be used in a single-step polishing method and/or may be used in one or more steps of a multi-step polishing method.

What is claimed is:

1. A buffing pad comprising:

a front surface portion featuring a plurality of indentations;

a moisture barrier upon which the front surface is disposed:

a compressible foam portion disposed below the moisture barrier; and a rear surface having an attachment portion, said attachment portion capable of attaching the buffing pad to a power tool;

wherein the plurality of indentations comprise a circular central indentation disposed in the center of the front surface portion;

three elongated secondary indentations located approximately one third of the way outward from the center of the front surface and disposed radially outward from the central indentation; and three significantly elongated tertiary indentations located approximately two thirds of the way outward from the center of the from surface and disposed radially outward from the secondary indentations.

2. The buffing pad of claim 1, wherein the front surface portion is formed from a fur-like fabric.

3. The buffing pad of claim 2, wherein the front surface portion is formed from a polyester fabric.

4. The buffing pad of claim 3, wherein the polyester fabric has a plurality of hairs on its surface.

5. The buffing pad of claim 4, wherein the hairs generally have an approximate length of 2 mm.

6. The buffing pad of claim 5, wherein the hairs are formed in a pattern such that at least one portion of hairs face in a direction different from the direction the hairs in a second portion face.

7. The buffing pad of claim 6, wherein the hairs are oriented such that there is a central section of hairs wherein the hairs are oriented in one direction and there are two outer sections disposed on either side of the central section wherein the hairs are oriented in a direction different from that of central section.

8. The buffing pad of claim 1, wherein the compressible foam portion is formed from a polyester foam.

9. The buffing pad, of claim 8, wherein the polyester foam has a 1.5-pound density.

10. The buffing pad of claim 1, wherein the compressible foam portion is approximately 0.5 inches thick.

11. The buffing pad of claim 1 wherein the moisture barrier is formed from a urethane film.

12. The buffing pad of claim 11, wherein the urethane film is approximately 1 mil thick.

13. The buffing pad of claim 1, wherein the rear surface is formed from a brushed nylon material.

14. The buffing pad of claim 1, wherein the attachment portion comprises one half of a hook and loop system.

15. The buffing pad of claim 1, further comprising the following configuration:

the front surface is approximately seven inches in diameter;

the central indentation is approximately 1.5 inches in diameter;

the three secondary indentations are bean-shaped, with a curvature facing inward toward the central indentation, wherein the secondary indentations are disposed approximately 0.5 inches outward from the central indentation, a major axis of the secondary indentations is approximately 1.5 inches long, and a minor axis of the secondary indentations is approximately 0.5 inches wide, and the secondary indentations are disposed approximately equidistant forming a broken circle pattern; and the tertiary indentations are bean-shaped, with a curvature facing inward toward the central indentation, wherein a major axis of the tertiary indentations is approximately 2.5 inches long and a minor axis of the tertiary indentations is approximately 0.5 inches wide, wherein the three tertiary indentations are disposed approximately equidistant forming a broken circle pattern, and the tertiary indentations are placed such that gaps between the tertiary indentations follow a line radiating outward from the central indentation and through a center point of the secondary indentations.

16. The buffing pad of claim 1, wherein the indentations are formed by RF welding.

* * * * *